United States Patent [19]

Adelmann

[11] Patent Number: 4,582,268

[45] Date of Patent: Apr. 15, 1986

[54] APPARATUS FOR TREATING A GRANULAR SUBSTANCE, ESPECIALLY NUCLEAR REACTOR FUEL IN POWDER FORM, AND METHOD FOR OPERATING THE APPARATUS

[75] Inventor: Manfred Adelmann, Bruchköbel, Fed. Rep. of Germany

[73] Assignee: Alkem GmbH, Hanau, Fed. Rep. of Germany

[21] Appl. No.: 521,703

[22] Filed: Aug. 9, 1983

[30] Foreign Application Priority Data

Aug. 12, 1982 [DE] Fed. Rep. of Germany ..... 3230039

[51] Int. Cl.[4] ..... B02C 17/02

[52] U.S. Cl. ..... 241/284; 141/98; 141/284; 241/71; 241/171; 241/177; 366/135; 366/180; 366/187; 414/291

[58] Field of Search ..... 241/30, 33, 70, 71, 241/72, 79.3, 81, 171, 177, 284; 414/405, 291; 222/565, 485; 141/284, 98; 366/135, 180, 187; 220/253

[56] References Cited

U.S. PATENT DOCUMENTS 965,813 7/1910 Greist ..... 241/79.3 X
1,517,538 12/1924 Daman ..... 241/177
3,325,066 6/1967 Allen ..... 222/565 X

FOREIGN PATENT DOCUMENTS 628977 4/1936 Fed. Rep. of Germany ..... 241/72

*Primary Examiner*—Howard N. Goldberg
*Assistant Examiner*—Joseph M. Gorski
*Attorney, Agent, or Firm*—Herbert L. Lerner; Laurence A. Greenberg

[57] ABSTRACT

Apparatus for treating a granular substance, especially for milling nuclear reactor fuel in powder form having a treatment drum supported rotatably about a central axis, an associated drive unit to drive the treatment drum about this central axis, and a cover at one end. The cover has two cover sections which are arranged side by side in the direction of the central axis of the treatment drum and can be rotated relative to each other about the central axis between two stops by means of a cover drive unit. The outer cover section has an opening for docking a substance container and the inner cover section has a passage opening which is aligned at one of the two stops with the opening for docking and which is closed at the other stop by the outer cover section. The treatment drum can be tilted about a tilting axis perpendicular to its central axis by means of a tilting unit.

14 Claims, 9 Drawing Figures

APPARATUS FOR TREATING A GRANULAR SUBSTANCE, ESPECIALLY NUCLEAR REACTOR FUEL IN POWDER FORM, AND METHOD FOR OPERATING THE APPARATUS

BACKGROUND OF THE INVENTION

1. Field of the invention

The invention relates to apparatus for treating a granular substance, especially nuclear reactor fuel in powder form, with a treatment drum which is supported rotatably about a central axis and can be driven about this central axis by means of an associated drive unit and has a cover at one end, and a method for operating the apparatus.

2. Description of the Prior Art

Such apparatus, designed as a ball mill, is commercially available. The treatment drum which can be filled with milling balls, is closed at one end by a one-piece cover which is pressed from the outside by means of a screw into the charging opening of the treatment drum which is located at this end. The screw is guided in a tapped hole which is made in a cross piece arranged crosswise over the opening with a cover and is held at both ends by a ring which is clamped on the outside to the cylinder surface of the treatment drum. The treatment drum is loosely supported with its outer cylinder surface and with the central axis horizontal between two cylindrical rolls on the cylinder surfaces of these two rolls which are arranged side by side with horizontal and mutually parallel longitudinal axes. One of these rolls is driven about its longitudinal axis by means of an electric motor and thus represents the drive unit which is associated with the treatment drum and by which the treatment drum can be driven about its central axis and is rotated.

The granular substance to be treated can be poured by hand into the treatment drum which is arranged with the central axis vertical, and can be poured out of the treatment drum after the treatment therein. This results of necessity in considerable dust development which can endanger the operating personnel especially in the case of a toxic or radioactive (for instance plutonium-containing) granular substance.

SUMMARY OF THE INVENTION

An object of the invention is to provide a method and apparatus to charge and empty the treatment drum for treating a granular substance with a materially reduced dust, generally without substantial dust.

With the foregoing and other objects in view, there is provided in accordance with the invention an apparatus for treating a granular substance, especially for milling reactor fuel to powder form, which comprises a treatment drum supported rotatably about a central axis, an associated drive unit to drive the treatment drum about the central axis, a cover at one end of the treatment drum, said cover comprising an outer cover section and an inner cover section, which two sections are arranged side by side in the direction of the central axis of the treatment drum a cover drive unit for rotating the two cover sections relative to each other about the central axis between two stops, an opening for docking a substance container in the outer cover section, a passage opening in the inner cover section which is aligned at one of the two stops with the opening for docking and which is closed at the other stop by the outer cover section, and a tilting unit for tilting the treatment drum about a tilting axis perpendicular to the central axis.

In accordance with the invention there is provided a method for operating the apparatus characterized by the features that the granular substance filled into the treatment drum from the substance container docked at the outer cover section through the cover is pretreated while the treatment drum rotates about its central axis; is subsequently transferred through the cover into the substance container docked at the outer cover section; and is there post-treated while the treatment drum rotates together with the docked substance container about the central axis of the treatment drum.

Other features which are considered as characteristic for the invention are set forth in the appended claims.

Although the invention is illustrated and described herein as embodied in an apparatus for treating a granular substance, especially nuclear reactor fuel in powder form, and method for operating the apparatus, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings in which:

FIG. 4 is a longitudinal section taken along line IV—IV of FIG. 2.

DETAILED DESCRIPTION OF THE INVENTION

Figure 1:
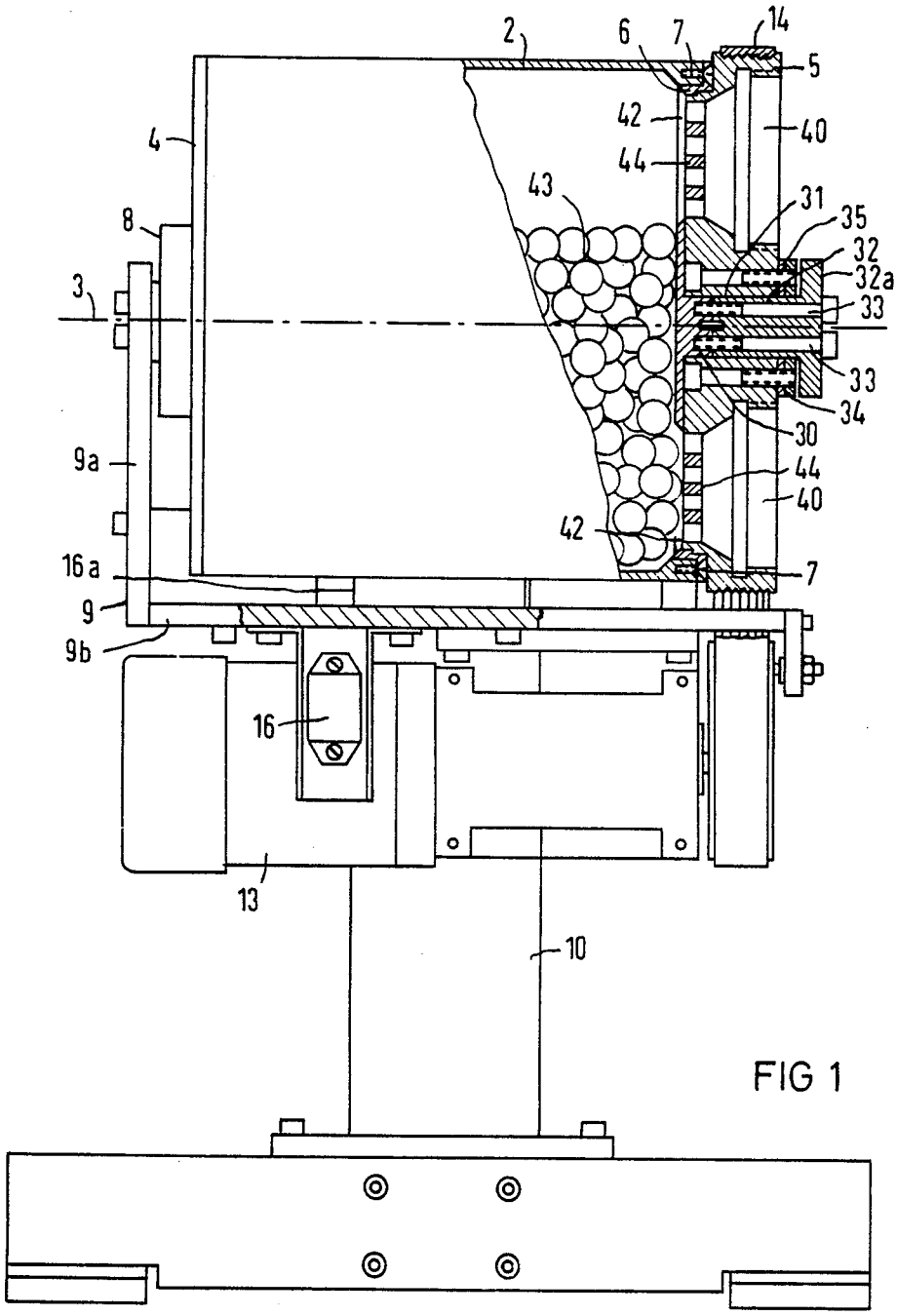
FIG. 1 shows a longitudinal section through part of an apparatus according to the invention. At the right side can be seen the cover made up of the outer cover section and inner cover section one of which sections is fixed to the drum and the other section rotatable relative to it. The outer cover section has openings for docking containers and the inner cover section has passageways for alignment with the openings.

According to the invention, apparatus of the type mentioned at the outset for solving this dust problem is characterized by the features that the cover comprises two cover sections which are disposed side by side in the direction of the central axis of the treatment drum, can be rotated relative to each other about the central axis between two stops by means of a cover drive unit. The outer cover section has an opening for docking a substance container and the inner cover section has a passage hole which is lined up at one of the two stops with the opening for docking and is closed off at the other stop by the outer cover section. The treatment drum can be tilted by means of a tilting unit about a tilting axis which is perpendicular to its central axis.

For filling-in the granular substance into the treatment drum, the treatment drum can be tilted about the tilting axis perpendicular to its central axis to an extent that the cover is at the lower end of the central axis.

Then, the substance container, in which the granular substance was, for instance, transported and/or stored, is opened and is docked with its opening against the opening of the outer cover section. Any pouring of the granular substance and thereby, all dust development can thus be avoided. Thereupon, the two cover sections of the cover can be rotated relative to each other by means of the cover drive unit to the stop at which the passage hole in the inner cover section is aligned with the opening for docking the substance container in the outer cover section. Subsequently, the treatment drum is tilted about the tilting axis such that the cover is at the upper end of the central axis of the treatment drum. In the process, the granular substance flows from the substance container into the treatment drum without liberation of dust to the atmosphere. This transfer process can be aided by rotating the treatment drum about its central axis. Then, the two cover sections of the cover are rotated relative to each other about the central axis in the other direction until at the other stop, the passage opening in the inner cover section is closed by the outer cover section. Thereupon, the treatment drum can be tilted about the tilting axis until the central axis of the treatment drum is horizontal. The treatment of the granular substance in the treatment drum can then start by rotating the treatment drum about its central axis. Here, too, any liberation of dust is avoided.

The granular substance pretreated in the treatment drum is returned into the substance container docked at the outer cover section of the cover. This is accomplished by first tilting the treatment drum about the tilting axis perpendicular to its central axis until the cover is at the lower end of the central axis. Thereupon the passage opening in the inner cover section of the cover is released, i.e. opened, as already described, so that the pretreated granular substance can move from the treatment drum into the substance container. This repouring process may be aided by rotating the treatment drum about its central axis.

After the passage opening in the inner cover section of the cover is closed, the substance container with the treated granular substance can be removed from the outer cover section and closed.

It is advantageous if the granular substance filled into the treatment drum from the substance container docked at the outer cover section through the cover and pretreated while the treatment drum rotates about its central axis, is subsequently refilled through the cover into the substance container docked at the outer cover section, and is post-treated there subsequently while the treatment drum rotates together with the docked substance container about the central axis of the treatment drum. This post-treatment can be performed with the central axis of the treatment drum set horizontal and may be, for instance, a build-up granulation of the granular substance container in the substance container. This post-treatment is also accomplished without liberation of dust. After the post-treatment, the substance container with the post-treated granular substance can be removed, likewise without release of dust, from the outer cover section of the cover, as already described above, and closed.

Several substance containers can be docked outside at the outer cover section of the cover of the treatment drum, and emptied sequentially into the treatment drum. These substance containers contain different granular substances which are mixed in the treatment drum. However, more than one docking opening can be provided at the outer cover section of the cover, and a corresponding number of passage openings at the inner cover section, such that several substance containers with granular substances to be filled into the treatment drum can be docked simultaneously at the outer cover section of the cover. Also, a post-treatment of the granular substances pretreated in the treatment drum can simultaneously be performed in these substance containers docked at the outer cover section of the cover by rotation of the treatment drum about its central axis.

The apparatus for treating a granular substance is of relatively compact design and therefore also particularly well suited for use in close quarters, for instance, in glove boxes such as are required, for instance, in plutonium technology.

The invention and its advantages will be explained in greater detail by two embodiment examples, making reference to the drawing.

Figure 2:
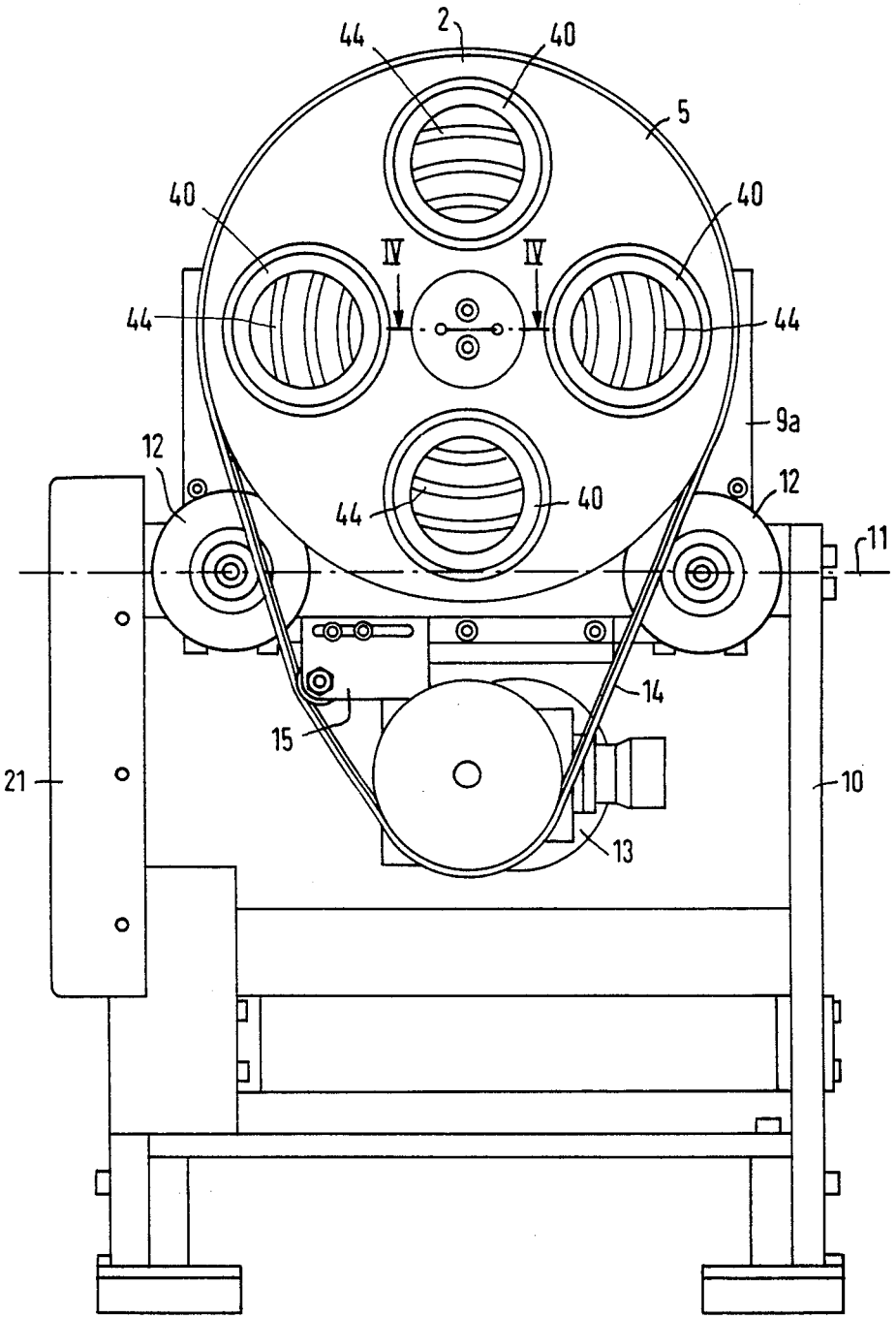
FIG. 2 shows a front view of the apparatus according to FIG. 1.
Figure 3:
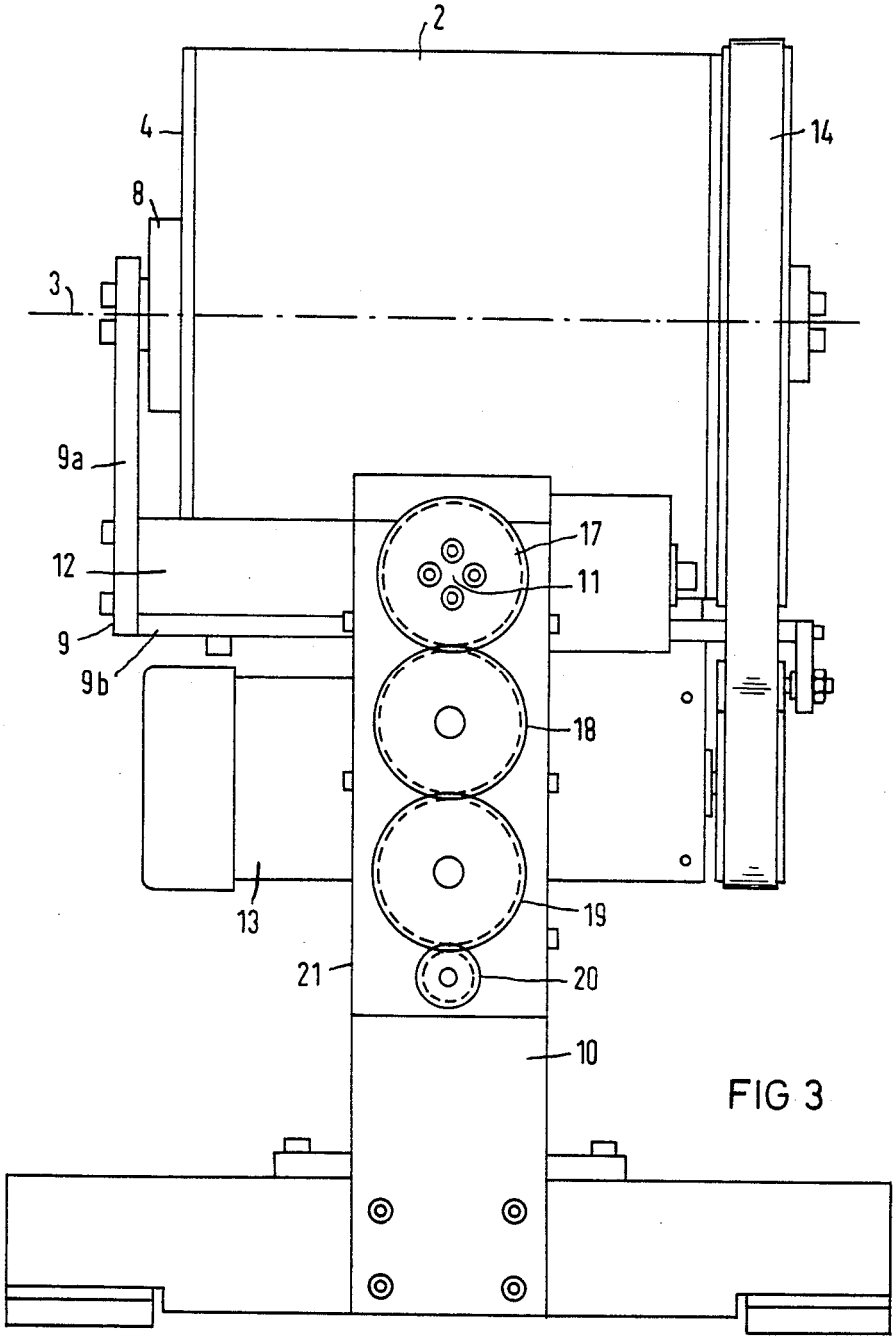
FIG. 3 shows a side view of the apparatus according to FIG. 1.
Figure 4:
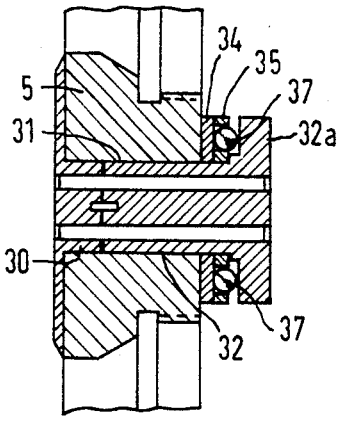
FIGS. 4–7 show a freewheel clutch in the apparatus according to FIGS. 1–3 and in different views, a detail of this freewheel clutch.
Figure 5:
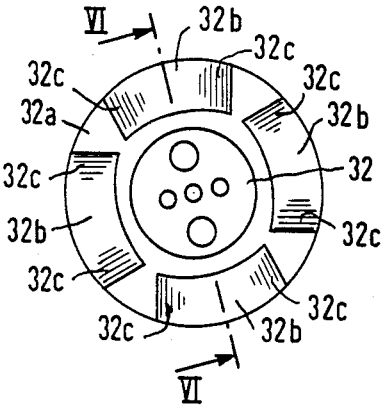
Figure 6:
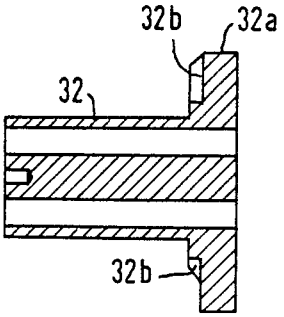
Figure 7:
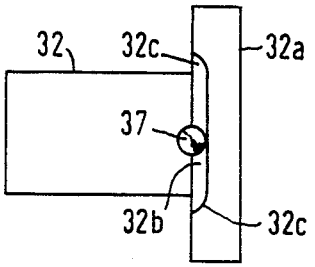

The apparatus according to FIGS. 1–3 has a hollow cylindrical treatment drum 2 with a central axis 3. The treatment drum 2 has a bottom 4 and a cover with an outer cover section 5 and an inner cover section 6. Both cover sections 5 and 6 are arranged coaxially with the treatment drum 2. They can be rotated relative to each other about the central axis 3. The inner cover section 6 is connected rigidly and tight to the treatment drum 2 by means of screws 7.

The bottom 4 of the treatment drum 2 is held at the center via a ball bearing 8 at the one leg **9*a* of an angular part 9. The other leg 9*b* is held at a stand 10 tiltably about a tilting axis 11. The leg 9*b* of the angular part 9 held at the stand 10 carries two support rolls 12, the longitudinal axes of which are parallel to the central axis 3 of the treatment drum 2. The treatment drum is disposed between the two longitudinal axes. The treatment drum 2 rests with its outer cylinder surface on the cylinder surface of the two support rolls 12. A drive motor 13 (FIG. 3) is arranged at the angular part 9 as the drive unit associated with the treatment drum 2 and has a drive belt 14 which engages the cylinder surface of the outer cover section 5 of the cover of the treatment drum 2. The drive belt 14 has a tightening element 15 mounted at the angular part 9. Mounted at the angular part 9, opposite the cylinder surface of the treatment drum 2, is an electromagnet 16 as a braking unit for the treatment drum 2**.

A gear is fastened, coaxially with the tilting axis 11, laterally at the leg **9*b* of the angular part 9, which is mounted tiltably about the tilting axis 11 at the stand 10. Gear 17 is preceded by three other gears 18, 19 and 20 which are mounted on the stand 10 and which belong to a tilting unit 21. The unit 21 is driven by an electric motor which has an adjustable end-position interrupter and is coupled to the gear 20. This makes this tiliting unit 21** self-locking.

A hollow cylindrical collar 30 with a central through hole 31 is on the outside in the center of the inner cover part 6. The outer cover section 5 is supported on collar 30. A cylindrical clutch part 32 of a freewheel clutch engages from the outside of the outer cover section 5 into hole 31. The clutch is fastened to the cylindrical collar 30 with screws 33 parallel to the axis 3. The outer cover part 5 is also supported on collar 30. At the outer end of the cylindrical clutch part 32 is an annular flange **32*a*. Milled cuts 32*b* at the flat inner end face of the flange 32*a*, spanning equal angular distances are provided. The milled cuts have the same angular spacings from each other and change at their ends into the inner end face of the flange 32***a* via inclined planes 32*c*. As a further clutch part of the freewheel clutch, a pressure ring 34 is bolted on the outside of the cover section 5 coaxially with the central hole 31 together with an annular, likewise coaxial ball cage 35 by means of axially-directed screws. The ball cage 35 is disposed between the pressure ring 34 and the flange 32*a*. In each of the milled cuts 32*b* of the flange 32*a* is a steel ball 37 positioned in the ball cage 35.

Four circular openings 40 for docking one each substance container 41 are provided in the outer cover section 5. The openings 40 have the same angular spacing from each other with respect to the central axis 3 of the treatment drum 2. Four passage openings 42 related to each opening 40 in the outer cover section 5 are arranged in the inner cover section 6. These passage openings 42 also have equal angular spacings from each other with respect to the central axis 3 of the treatment drum 2.

In the treatment drum 2 is a bed 43 of loose milling bodies. These milling bodies may be steel balls. It is advantageous if a screen 44 is attached in each opening 40 of the outer cover section 5. The mesh width of screen 44 is chosen of a size that the milling bodies of the bed 43 in the treatment drum 2 cannot pass through the screens 44 and from there through the openings 42 and 40.

It is advantageous if in the bottom 4 of the treatment drum 2, at the point of intersection of the central axis 3, a feed opening, not shown, for an additive substance is provided. As illustrative, a milling agent can be introduced into the treatment drum 2 through the feed opening during the rotation of the treatment drum 2 about its central axis 3.

Figure 8:
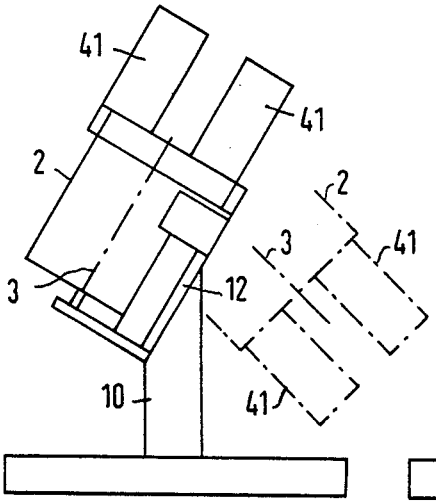
FIGS. 8 and 9 show schematically the apparatus according to FIGS. 1–3 in different operating states.

Substance containers 41 containing, for instance, $UO_2$- and $PuO_2$-powder are docked in the four openings 40 of the outer cover sections 5, by first tilting the treatment drum 2 about the tilting axis 11 into the position shown by dashed lines in FIG. 8, in which the cover section 5 is at the lower end of the axis of rotation 3. Then, the open substance containers 41 are docked in the openings 40 of the outer cover section 5. Thereupon, the treatment drum 2 is tilted about the tilting axis 11 until the outer cover section 5 with the substance containers 41 docked therein is at the upper end of the central axis 3 of the treatment drum 2. At the time of tilting, the treatment drum 2 is set in rotation about the central axis 3 by means of the drive motor 13 which represents the drive unit of the treatment drum 2. In this connection it is advantageous if the drive unit, i.e., the electric motor 13, for the treatment drum 2 together with the treatment drum 2 is arranged tiltably about its tilting axis 11 since then a simple V-belt 14 is sufficient to transmit the torque from the drive unit to the outer cover section 5.

The direction of rotation of the treatment drum 2 about its central axis 3 is chosen so that the balls 37 of the freewheel clutch between the two cover sections 5 and 6 are pushed by the outer cover section 5 against those inclined planes 32*c*, representing a stop, of the milled-out cuts 32*b*, at which stop the docking openings 40 in the outer cover section 5 are aligned with one of the respective passage openings 42 in the inner cover section 6. The oxide powder contained as the granular substance in the substance containers 41 can therefore flow through openings 42 into the interior of the treatment drum 2 through the cover formed by the two cover sections 5 and 6.

After the oxide powder is transferred from the substance containers 41 into the treatment drum 2, the direction of rotation of the electric motor 13 and thereby also the direction of rotation of the treatment drum about its central axis 3 is reversed. In this process, the outer cover section 5 rotates relative to the inner cover section 6 about the central axis 3 of the treatment drum 2 until the steel balls 37 of the freewheel clutch between the two cover sections 5 and 6 are pressed against the inclined planes 32*c* representing the second stop at the other ends of the milling cuts 32*b* at the inner end face of the flange 32*a*. There, the docking openings 40 and the passage openings 42 respectively are closed by the inner cover section 6 and the outer cover section 5, respectively. Furthermore, the two cover sections are pressed against each other by the steel balls 37 of the freewheel clutch, forming a dust-tight seal.

The drive unit for the treatment drum formed by the drive motor 13 in the apparatus shown in the drawing serves also as the cover drive unit for the cover formed by the cover sections 5 and 6. The cover drive unit engages the outer cover section 5 of the cover which is rotatable relative to the treatment drum 2.

It is advantageous if, upon reversal of the direction of rotation of the treatment drum 2 about its central axis 3, the treatment drum 2 is braked by a braking unit which is formed by a brake shoe 16*a* with associated electromagnet 16. After the electromagnet 16 is switched on, the brake shoe 16*a* increases the moment of inertia of the treatment drum 2 that the outer cover section 5 can be turned without difficulty to the other stop relative to the inner cover section 6, at which the docking opening 40 and the passage openings 42 are closed. After these openings are closed, the electromagnet 16 can be switched off.

Figure 9:
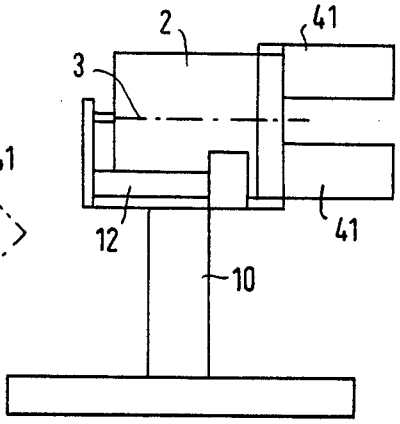

As soon as the cover of the treatment drum 2 is closed, the treatment drum 2 is tilted about the tilting axis 11 into the operating position, in which position the central axis 3 of the treatment drum 2 is horizontal. Also, in this position the treatment drum 2 is driven by means of the drive motor 13 and the drive belt 14 via the outer cover section 5. The freewheel clutch disposed between the cover sections 5 and 6 keeps the docking openings 40 in the outer cover section 5 and the passage openings 42 in the inner cover section 6 closed dust-tight. The oxide powder filled into the treatment drum 2 is subjected in the drum to a pretreatment consisting of milling while maintaining the drum in the operating position shown in FIG. 9. After this milling pretreatment is completed, the treatment drum 2 is tilted again about the tilting axis 11 into the docking or emptying position shown in dashed lines in FIG. 8. Then the direction of rotation of the treatment drum 2 about its central axis 3 is reversed, to bring each of the docking openings 40 in the outer cover section 5 into alignment with the corresponding passage opening 42 in the cover section 6. Here also, the moment of inertia of the treatment drum 2 can be increased temporarily by means of the electromagnet 16 which is effective as a braking unit. The oxide powder pretreated by milling in the treatment drum 2 now passes through the openings 40 and 42 into the substance containers 41 docked at the outer cover 5.

It is advantageous if the openings 40 for docking the substance containers 41 at the outer cover section 5 and the passage openings 42 at the inner cover section 6 are located at the outer edge of the cover. This ensures that the oxide powder to be transferred into the substance containers 41 is emptied from the treatment drum 2 without leaving a residue behind.

After the oxide powder is transferred into the substance containers 41 in the docking or emptying position of the treatment drum 2 shown in FIG. 8, the direction of rotation of the cover section 5 and of the treatment drum 2 about the central axis 3 can be reversed again and thereby, the cover of the treatment drum 2 comprising the cover sections 5 and 6, can be closed again. After tilting the treatment drum 2 together with the drive motor 13 back into the operating position according to FIG. 9, in which the central axis 3 is horizontal, a post-treatment of the oxide powder in the co-rotating substance containers 41 can be performed by continuing the rotation of the treatment drum 2 about the central axis 3 with the cover closed. This post-treatment may be, for instance, a build-up granulation of the oxide powder. After this post-treatment is finished, the treatment drum 2 is tilted again into the docking and emptying position shown in dashed lines in FIG. 8, in which the substance containers 41 filled with the oxide powder can be removed from the outer cover section 5 and closed without raising dust.

Transferring and refilling the oxide powder from the substance containers 41 into the treatment drum 2 and from the treatment drum 2 into the substance containers 41 and corresponding treatment in the treatment drum 2 as well as in the substance containers 41 by rotation of the treatment drum 2 together with the substance containers 41 docked at the outer cover section 5 can also be performed repeatedly with the same oxide powder. It is advantageous, especially if this interplay is to take place over an extended period of time, if an automatic control is associated with the drive unit for the treatment drum 2, the cover drive unit which in the embodiment example shown is identical with the drive unit for the treatment drum, and the tilting unit.

The foregoing is a description corresponding, in substance, to German application No. P 32 30 039.5, dated Aug. 12, 1982, international priority of which is being claimed for the instant application and which is hereby made part of this application. Any material discrepancies between the foregoing specification and the specification of the aforementioned corresponding German application are to be resolved in favor of the latter.

There is claimed:

1. Apparatus for treating a granular substance, especially for milling reactor fuel to powder form, comprising a treatment/drum said treatment drum having an imperforate body between its ends and being rotatably supported about a central axis which extends in a direction from one end of the drum to the other end of the drum; an associated drive unit to drive the treatment drum about the central axis; a cover at one end of the treatment drum, said cover comprising an outer cover section and an inner cover section, which two sections are arranged side by side in the direction of the central axis of the treatment drum; and cover drive unit for rotating the two cover sections relative to each other about the central axis between two stops; an opening in the outer cover section for docking a substance container; a passage opening in the inner cover section which is aligned at one of the two stops with the opening for docking and which is covered at the other stop by the outer cover section; and a tilting unit for tilting the treatment drum about a tilting axis perpendicular to the central axis.

2. Apparatus according to claim 1, wherein one of the two cover sections of the cover is rigidly connected to the treatment drum, and the other cover section can rotate about the central axis of the treatment drum relative to the rigidly connected cover.

3. Apparatus according to claim 2, wherein the inner cover section of the cover is rigidly connected to the treatment drum.

4. Apparatus according to claim 2, wherein the drive unit for the treatment drum also serves as a drive unit for the cover and engages the cover section of the cover which is rotatable relative to the treatment drum.

5. Apparatus according to claim 4, including a braking unit for braking the treatment drum.

6. Apparatus according to claim 2, wherein the drive unit engages the treatment drum, and wherein a braking unit for the cover section of the cover which is rotatable relative to the treatment drum is provided.

7. Apparatus according to claim 1, wherein the tilting unit is self-locking.

8. Apparatus according to claim 1, wherein the drive unit for the treatment drum together with the treatment drum is arranged tiltably about the tilting axis.

9. Apparatus according to claim 1, wherein the treatment drum contains a bed of milling balls.

10. Apparatus according to claim 1, wherein a screen is arranged of the opening of the outer cover section for docking the substance container.

11. Apparatus according to claim 1, wherein the opening in the outer cover section for docking the substance container and the passage opening in the inner cover section are located at an outer edge of the cover.

12. Apparatus according to claim 1, wherein a freewheel clutch is arranged between the outer and the inner cover sections of the cover, which clutch presses the two cover sections together in the direction of the central axis of the treatment drum at the two stops.

13. Apparatus according to claim 1, wherein a feed opening for an additive substance is provided in a bottom of the treatment drum.

14. Apparatus according to claim 1, wherein an automatic control is associated with the drive unit for the treatment drum, the cover drive unit and the tilting unit.

* * * * *